United States Patent [19]

Noori-Shad et al.

[11] Patent Number: 4,974,136

[45] Date of Patent: Nov. 27, 1990

[54] LIGHT FIXTURE

[75] Inventors: Feraydon Noori-Shad, Laguna Niguel; Ebrahim Ladjevardi; Alex H. Ladjevardi, both of Costa Mesa, all of Calif.

[73] Assignee: Artup Corporation, Santa Ana, Calif.

[21] Appl. No.: 429,773

[22] Filed: Oct. 31, 1989

[51] Int. Cl.[5] ..... F21V 9/00

[52] U.S. Cl. ..... 362/293; 362/806; 362/283; 362/322; 362/231; 350/311

[58] Field of Search ..... 362/277, 293, 287, 431, 362/280, 281, 282, 283, 319, 321, 322, 323, 806, 811, 231, 230, 232, 147; 40/431, 452, 581; 350/311, 318

[56] References Cited

U.S. PATENT DOCUMENTS

| | | | |
|---|---|---|---|
| 3,609,339 | 9/1971 | Smith | 362/293 |
| 4,125,888 | 11/1978 | Tsuchihashi et al. | 362/811 |
| 4,138,714 | 2/1979 | Tsuchihashi et al. | 362/231 |
| 4,233,654 | 11/1980 | Tsuchihashi et al. | 362/806 |
| 4,454,570 | 6/1984 | Morello | 362/293 |
| 4,535,394 | 8/1985 | Dugre | 362/293 |
| 4,716,506 | 12/1987 | Shang | 302/293 |

*Primary Examiner*—Stephen F. Husar
*Assistant Examiner*—D. M. Cox
*Attorney, Agent, or Firm*—Stetina and Brunda

[57] ABSTRACT

A light fixture for providing an aesthetically pleasing multi-colored pattern of illumination is disclosed. The light fixture comprises a housing for mounting a light bulb, a plurality of dichroic filters positioned within the beam of the light bulb, and a mounting fixture for securing and positioning the dichroic filters. Each of the dichroic filters will typically have different optical properties such that the reflected and transmitted light from each dichroic filter contributes a different color to the pattern. A second embodiment having an adjustable filter positioning means is also disclosed.

12 Claims, 1 Drawing Sheet

LIGHT FIXTURE

FIELD OF THE INVENTION

The present invention relates generally to light fixtures and more particularly to a light fixture for providing an aesthetically pleasing multi-colored pattern of illumination. The light fixture comprises a housing for mounting a light bulb, a plurality of dichroic filters positioned within the beam of the light bulb, and a mounting fixture for securing and positioning the dichroic filters. Each of the dichroic filters will typically have different optical properties such that the reflected and transmitted light from each dichroic filter contributes a different color to the pattern. An adjustable filter positioning means can be utilized to permit the pattern to be varied.

BACKGROUND OF THE INVENTION

Light fixtures for providing aesthetically pleasing multi-colored patterns of light are well known. Examples of such light fixtures are commonly used to illuminate Christmas trees and to provide diverse effects in discotheques and nightclubs. Such multi-colored lighting systems typically comprise a light source and filter means. The filter means is usually either colored cellophane or a gelatin-coated glass filter. Such filters are strictly transmission filters wherein the desired color or colors are obtained by permitting light to pass through the filters. Only a single color is associated With each individual filter. A plurality of filters is required to obtain multiple color effects. One filter must be used for each color desired.

Such multi-colored lighting systems are aesthetically pleasing and have found application in both home and commercial use. However, conventional multi-colored lighting systems are limited in the number of colors that they can produce since they require a separate filter for each desired color. It would be desirable to manufacture a multi-colored lighting system wherein more than one color can be obtained from each filter. As such, although the prior art has recognized the desirability of multi-color lighting systems, the problem of providing a filter from which more than a single color can be obtained has heretofore never been addressed.

SUMMARY OF THE INVENTION

The present invention specifically addresses and alleviates the above-mentioned deficiencies associated in the prior art. More particularly, the present invention comprises a light fixture for providing an aesthetically pleasing multi-colored pattern of illumination, comprising a housing for mounting a light bulb, a plurality of dichroic filters positioned within the beam of the light bulb, and a mounting fixture for securing and positioning the dichroic filters. Each of the dichroic filters will typically possess different optical properties such that the reflected and transmitted light from each dichroic filter contributes a different color to the composite emitted light pattern. The filter positioning means can be adjustable to permit the pattern to be varied.

The light fixture of the present invention provides a very pleasing multi-colored light display. The light display has four separate beams formed by placing two optically different dichroic filters in the beam of an incandescent light source such that light is both transmitted through and reflected from each of the dichroic filters. The light transmitted through a given dichroic filter will appear as a different color from the light transmitted through the same dichroic filter. The light transmitted through and the light reflected from the second dichroic filter will both be different in color from the light transmitted through and the light reflected from the first dichroic filter, thus providing multiple, i.e. four, separate colors of light. Some of the original white light that has not passed through either of the dichroic filters will interact with the colored beams of light, thereby contributing to the pattern so formed.

These, as well as other future advantages, will be more apparent from the following description and drawings. It is understood that changes in the specific structure shown and described may be made within the scope of the claims without departing from the spirit of the invention.

DETAILED DESCRIPTION OF A PREFERRED EMBODIMENT

Figure 1:
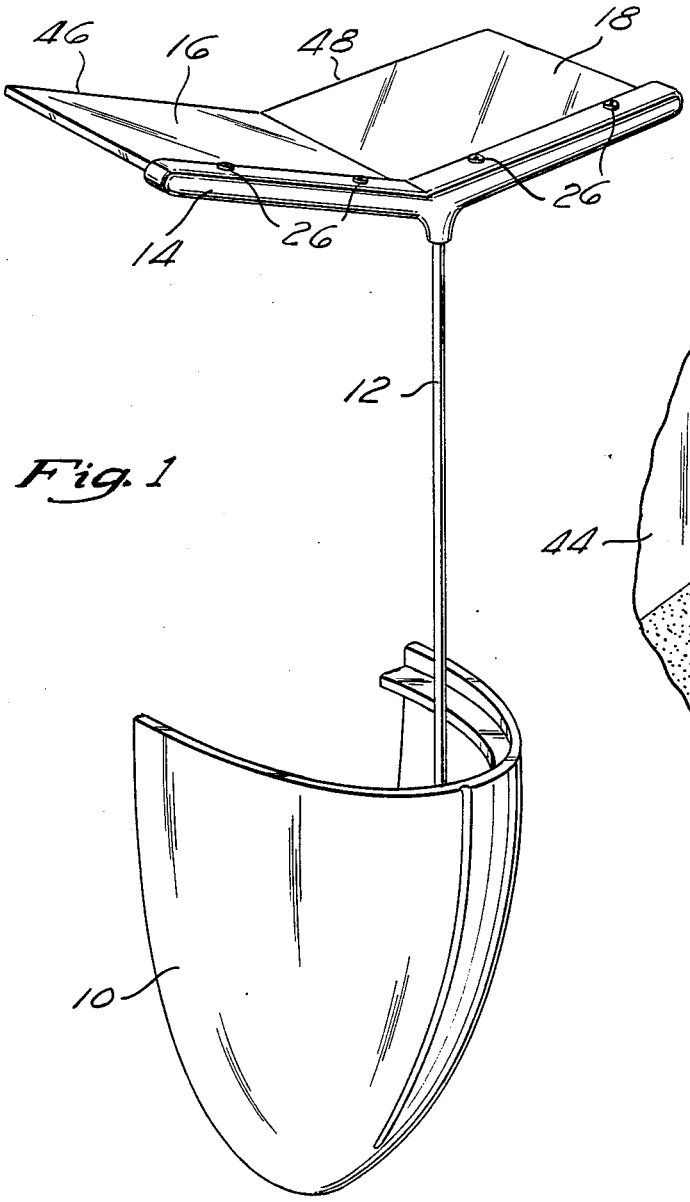
FIG. 1 is a perspective view of the light fixture showing the dichroic filters mounted above the housing.

The light fixture of the present invention is illustrated in FIGS. 1–5 which depict a presently preferred embodiment of the invention.

Referring now to FIGS. 1 through 4, a housing 10 contains an incandescent light bulb 22 secured to the housing 10 through a socket 24. A support post 12 attaches the housing 10 to a filter mount 14. First 16 and second 18 dichroic filters are secured to the filter mount 14 using attachment means such as allen screws 26. As is known, such dichroic filters comprise a planar glass substrate having multi-layer coatings applied thereto which reflect a portion of the light spectrum while transmitting the remaining portion and are therefore dielectric interference type filters. Although various such filters may be utilized, a preferred candidate is that manufactured and/or marketed by G. M. Vacuum Coating Laboratory, Inc. of Newport Beach, Calif. The dichroic filters are preferably mounted at an angle of approximately 15 degrees to the horizontal. This places the dichroic filters at an angle of 105 degrees to the incident light radiating from light source 22. Dependent upon filter construction selected the dichroic filters produce desirable multi-colored patterns when mounted at between 45 degrees and 135 degrees to the incident light.

Figure 2:
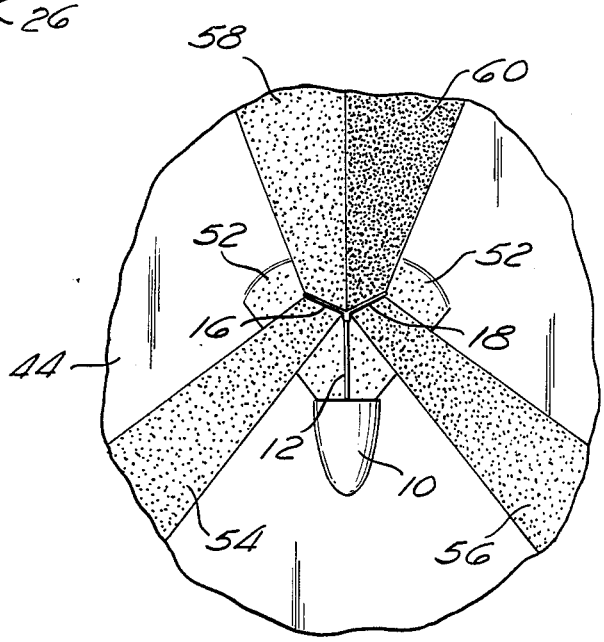
FIG. 2 is a side plan view of the light fixture showing the pattern formed by the interaction of reflection and transmitted light with non-incident light.
Figure 3:
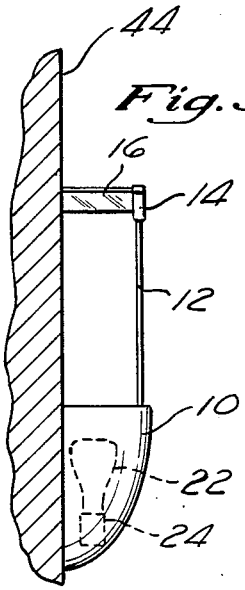
FIG. 3 is a side plan view of the light fixture showing it mounted to a vertical structure and illustrating the position of the incandescent bulb mounted within the housing.
Figure 4:
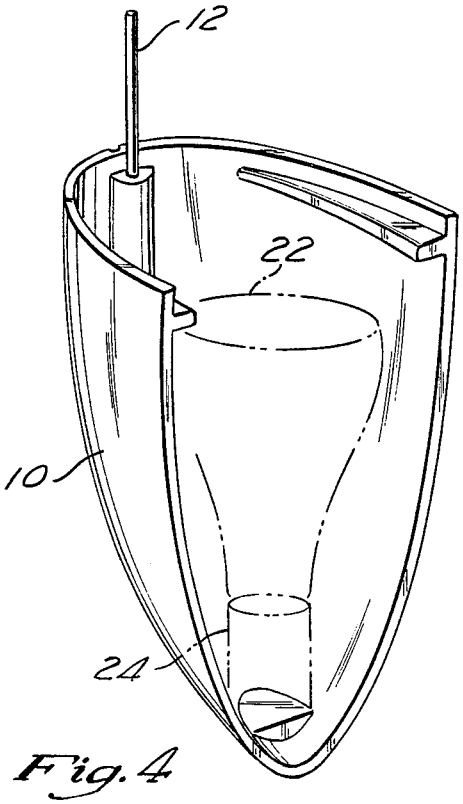
FIG. 4 is a perspective view of the inside of the housing showing the mounting of an incandescent bulb therewithin.

As shown in FIG. 3, the light fixture is mounted to a vertical surface 44 such that the support post 11 is preferably substantially vertical and the dichroic filters and 18 are oriented above the housing 10. The edges 46 and 48 of dichroic filters 16 and 18, respectively, should mount flush to the vertical surface 44 to prevent white light from passing between the dichroic filters 16 and 18 and the vertical surface 44. Any white light that is permitted to pass between the dichroic filters 16 and 18 and the vertical surface 44 tends to bleach the colors from the upper portion of the pattern depicted in FIG. 2.

Referring now to FIG. 2, a multi colored pattern is formed by the interaction of non-incident light with incident light. The non-incident light is that light which does not strike the dichroic filters 16 and 18. The incident light is that light which is either transmitted through or reflected from the dichroic filters 16 and 18.

The light bulb 22 mounted within the housing 10 is preferably of the self-contained halogen reflector type. The light bulb 22 radiates a beam of light 52 from the housing 10. A portion of the radiated beam 52 is incident upon the first 16 and second 18 dichroic filters. The incident portion of the radiated beam 52 is either reflected or transmitted. Due to the inherent characteristics of dichroic filters, the reflective beams 54 and 56 are of a different color from the transmitted beams 58 and 60. Also, since the two dichroic filters 16 and 18 are optically different, both the reflected 54 and transmitted 58 beams of the first dichroic filter 16 are of a different color from the reflected 56 and transmitted 60 beams of the second 18 dichroic filter. Therefore, beams of four separate colors are formed by the reflection and transmission of light through two separate dichroic filters 16 and 18. The light reflected from and transmitted through dichroic filters 16 and 18 interacts with the nonincident light 52, which is not incident upon the dichroic filters 16 and 18, to form an aesthetically pleasing pattern of light upon the vertical surface 44 upon which the light fixture is mounted.

It is the light which forms the transmitted beams 58 and 60 that would tend to be bleached out if a gap were to exist between the dichroic filters 16 and 18, and the vertical surface 44. This would occur since the white light would tend to obscure the colored light transmitted by the dichroic filters 16 and 18.

As shown in FIG. 3, the light fixture of the present invention is generally used by attaching it to a vertical surface. As those skilled in the art will recognize, various attachment means are possible.

Figure 5:
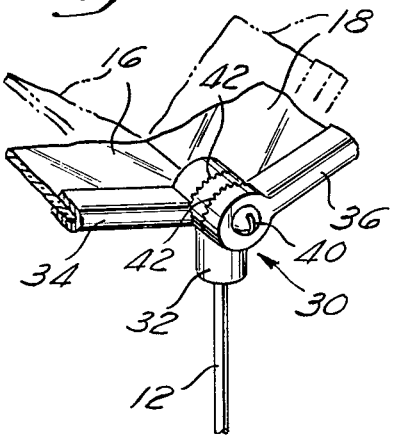
FIG. 5 is a perspective sectional view of an adjustable filter mount showing alternative filter positions.

Referring now to FIG. 5, a second embodiment of the present invention utilizes an adjustable mount 30 to attach the dichroic filters 16 and 18 to the support post 12. First 34 and second 36 filter mounts rotatably attach to a collar 32 using an attachment means such as a screw 40. The interface between each of the filter mounts 34 and 36 and the collar 32 has teeth 42 formed thereon, such that when screw 40 is tightened, the positions of filter mounts 34 and 36 become rigid with respect to collar 32. Loosening screw 40 permits the rotation of filter mounts 34 and 36 by permitting the teeth 42 to disengage. This permits readjustment of the dichroic filters 16 and 18, thereby allowing the user to vary the pattern 50 thus formed.

It is understood that the exemplary light fixture described herein and shown in the drawings represents only a presently preferred embodiment of the invention. Indeed, various modifications and additions may be made to such embodiment without departing from the spirit and scope of the invention. For example, the dichroic filters could be formed such that they are attachable to conventional light fixtures. That is, the dichroic filters could attach to an existing, previously installed light fixture. It is further understood that various mounting means for attaching the dichroic filters to a light fixture are possible and that such variations in mounting are obvious to those skilled in the art. Thus, these and other modifications and additions may be obvious to those skilled in the art and may be implemented to adopt the present invention for use in a variety of different applications.

What is claimed is:

1. A light fixture having a light source for forming a multi-color pattern upon a surface, comprising:

(a) at least one dichroic filter mountable within the beam of the light source such that incident light reflected by said dichroic filter and incident light transmitted by said dichroic filter cooperate with light from said light source which is not incident upon said dichroic filter to form a multi-color pattern upon the surface.

2. The light fixture as recited in claim 1 further comprising a housing, within which the light source is mounted and to which said dichroic filters are attainable.

3. The light fixture as recited in claim 2 wherein said dichroic filters are mounted such that their planar surface forms an angle of between 45 degrees and 135 degrees to light incident from the light source.

4. The light fixture as recited in claim 3 wherein:

(a) the dichroic filters are mounted such that their planar surface forms an angle of approximately 105 degrees to light incident from the light source;

(b) light reflected from the first dichroic filter forms a first beam of a first color, the first beam forming an angle of approximately 30 degrees to the light incident from the light source;

(c) light transmitted by the first dichroic filter forms a second beam of a second color, the second beam forming an angle of approximately 0 degree to the light incident from the light source;

(d) light reflected from the second dichroic filter forms a third beam of a third color, the third beam forming an angle of approximately 30 degrees to the light incident from the light source;

(e) light transmitted by the second dichroic filter forms a fourth beam of a fourth color, the fourth beam forming an angle of approximately 0 degree to the light incident from the light source; and (f) the first, second, third, and fourth beams are each of different colors.

5. The light fixture as recited in claim 3 wherein said dichroic filters are movably mounted within the beam of said light source.

6. A light fixture having a light source, for forming a multi-color pattern upon a surface, comprising:

(a) a housing for containing the light source;

(b) an elongate support post attached to said housing;

(c) a filter mount attached to said support post; and (d) at least one dichroic filter attached to said filter mount such that incident light reflected by said dichroic filter and incident light transmitted by said dichroic filter cooperate with light from said light source which is not incident upon said dichroic filter to form a multi-color pattern upon the surface.

7. The light fixture as recited in claim 6 wherein at least two dichroic filters are attached to said filter mount.

8. The light fixture as recited in claim 6 wherein each of said dichroic filters are mounted such that their planar surface forms an angle of between 35 degrees and 135 degrees to light incident from the light source.

9. The light fixture as recited in claim 7 wherein said dichroic filters are movably attached to said filter mount such that the angle upon which light from the light source is incident upon said dichroic filters can be varied.

10. The light fixture as recited in claim 7 wherein:

(a) the dichroic filters are mounted such that their planar surface forms an angle of approximately 105 degrees to light incident from the light source;

(b) light reflected from the first dichroic filter forms a first beam of a first color, the first beam forming an angle of approximately 30 degrees to the light incident from the light source;

(c) light transmitted by the first dichroic filter forms a second beam of a second color, the second beam forming an angle of approximately 0 degree to the light incident from the light source;

(d) light reflected from the second dichroic filter forms a third beam of a third color, the third beam forming an angle of approximately 30 degrees to the light incident from the light source;

(e) light transmitted by the second dichroic filter forms a fourth beam of a fourth color, the fourth beam forming an angle of approximately 0 degree to the light incident from the light source; and (f) the first, second, third, and fourth beams are each of different colors.

11. A light fixture having a light source for forming a multi-color pattern upon a surface comprising:

(a) first and second dichroic filters mountable within the beam of the light source such that incident light reflected by said dichroic filter and incident light transmitted by said dichroic filter cooperate with light from said source which is not incident upon said dichroic filters to form a multi-color pattern upon the surface;

(b) a housing within which the light source is mounted and to which said dichroic filters are attachable;

(c) wherein said dichroic filters are mounted such that their planar surface forms an angle of approximately 105 degrees to light incident from the light source; and (d) wherein light reflected from the first dichroic filter forms a first beam of a first color, the first beam forming an angle of approximately 30 degrees to the light incident from the light source, (e) wherein light transmitted by the first dichroic filter forms a second beam of a second color, the second beam forming an angle of approximately 0 degrees to the light incident from the light source;

(f) wherein light reflected from the second dichroic filter forms a third beam of a third color, the third beam forming an angle of approximately 30 degrees to the light incident from the source;

(g) wherein light transmitted by the second dichroic filter forms a fourth beam of a fourth color, the fourth beam forming an angle of approximately 0 degrees to the light incident from the light source; and (h) the first, second, third, and fourth beams are each of different colors.

12. A light fixture having a light source, for forming a multi-color pattern upon a surface, comprising:

(a) a housing for containing the light source;

(b) an elongate support post attached to said housing;

(c) a filter mount attached to said support post;

(d) at least two dichroic filters attached to said filter mount;

(e) wherein the dichroic filters are mounted such that their planar surface forms an angle of approximately 105 degrees to light incident from the light source;

(f) wherein light reflected from the first dichroic filter forms a first beam of a first color, the first beam forming an angle of approximately 30 degrees to the light incident from the light source;

(g) wherein light transmitted by the first dichroic filter forms a second beam of a second color, the second beam forming an angle of approximately 0 degrees to the light incident from the light source;

(h) wherein light reflected from the second dichroic filter forms a third beam of a third color, the third beam forming an angle of approximately 30 degrees to the light incident from the light source;

(i) wherein light transmitted by the second dichroic filter forms a fourth beam of a fourth color, the fourth beam forming an angle of approximately 0 degrees to the light incident from the light source; and (j) wherein the first, second, third, and fourth beams are each of different colors.

* * * * *